United States Patent [19]

Lewis

[11] Patent Number: 4,950,301

[45] Date of Patent: Aug. 21, 1990

[54] KERATINOUS TEXTILE TREATMENT WITH ARYLATING COMPOUNDS CONTAINING FIBRE REACTIVE GROUPS

[75] Inventor: David M. Lewis, Otley, England

[73] Assignee: Wool Development International Limited, West Yorkshire, England

[21] Appl. No.: 290,887

[22] Filed: Dec. 22, 1988

Related U.S. Application Data

[63] Continuation of Ser. No. 775,136, Sep. 12, 1985, abandoned, which is a continuation-in-part of Ser. No. 577,131, Feb. 6, 1984, Pat. No. 4,563,189.

[30] Foreign Application Priority Data

Sep. 14, 1984 [GB] United Kingdom ..... 8423291
May 23, 1985 [GB] United Kingdom ..... 8513081

[51] Int. Cl.[5] ..... C07C 147/06; C07D 239/26; D06M 13/26; D06P 1/64

[52] U.S. Cl. ..... 8/127.5; 8/127.6; 8/543; 8/917; 8/490; 8/128.1; 8/128.3; 544/180; 564/47; 564/49; 564/85; 564/209; 568/28

[58] Field of Search ..... 8/127.5, 127.6, 128 R

[56] References Cited

U.S. PATENT DOCUMENTS

| | | | |
|---|---|---|---|
| 3,278,253 | 10/1966 | Weckler et al. | 8/566 |
| 3,758,579 | 9/1973 | Martin et al. | 71/118 |
| 3,881,909 | 5/1975 | Martin et al. | 71/118 |
| 3,890,091 | 6/1975 | Cathelin et al. | 8/495 |
| 4,113,431 | 9/1978 | Terada et al. | 8/120 |
| 4,142,853 | 3/1979 | Terada et al. | 8/120 |
| 4,286,958 | 9/1981 | Fujiu et al. | 8/471 |
| 4,313,732 | 2/1982 | Teague et al. | 8/541 |
| 4,392,265 | 7/1983 | Fujiu et al. | 8/120 |
| 4,504,272 | 3/1985 | Ong | 8/543 |
| 4,563,189 | 1/1986 | Lewis | 8/493 |

FOREIGN PATENT DOCUMENTS

| | | |
|---|---|---|
| 36582 | 9/1981 | . |
| 118983 | 9/1984 | European Pat. Off. . |
| 49-41686 | 4/1974 | Japan . |
| 51-119885 | 10/1976 | Japan . |
| 934391 | 8/1963 | United Kingdom . |

*Primary Examiner*—A. Lionel Clingman
*Attorney, Agent, or Firm*—Darby & Darby

[57] ABSTRACT

A method of treating natural or synthetic polyamide or cellulosic textiles comprises applying an effective amount of an arylating agent, preferably to the dyebath. The arylating agent may be of a formula $Ar—(X—Y)_n$ wherein Ar is an aromatic residue such as substituted or unsubstituted benzene or naphthalene ring; X is a bridging group such as $—SO_2$, —CO— or —NH—; Y is a reactive group; and n is 1 to 3. The arylating agent reduces fibre damage of natural polyamide fibres during dyeing and proves the degree of dye fibre reaction in dyeing of polyamide and cellulosic textiles to improve wet fastness. Furthermore, on cellulosic textiles, wet and dry wrinkle recovery properties are improved as is the yield of reactive dye fixation. On keratinous fibres shrink resistant and moth resistant properties are improved also. Certain novel arylating compounds are disclosed also.

7 Claims, 1 Drawing Sheet

Figure 2:
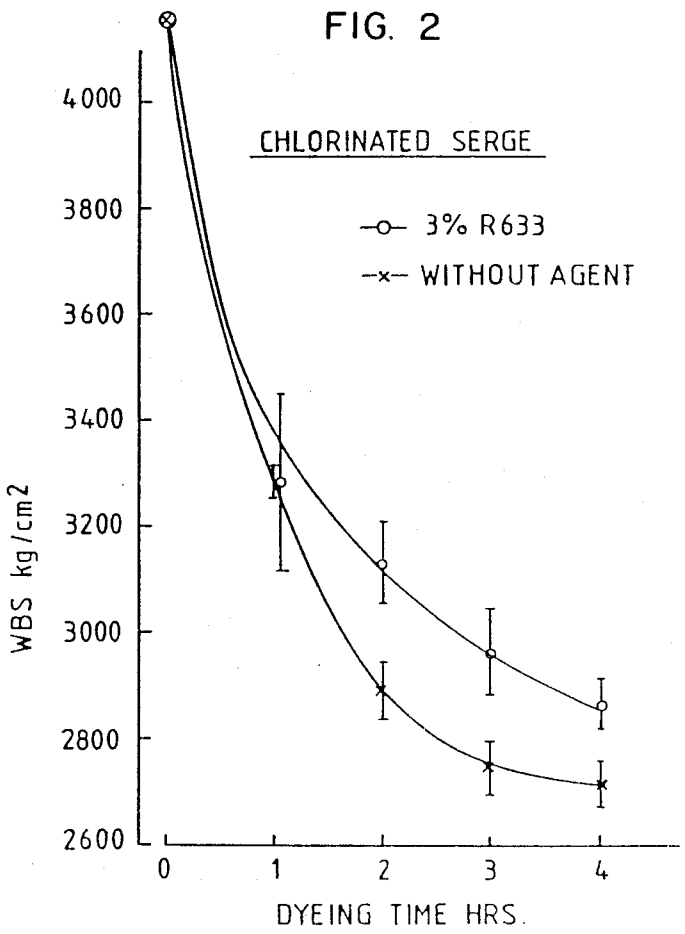

CHLORINATED SERGE
-o- 3% R633
-x- WITHOUT AGENT
WBS kg/cm2
4000
3800
3600
3400
3200
3000
2800
2600
0
1
2
3
4
DYEING TIME HRS.

UNTREATED SERGE
-o- 3% R 633
-x- WITHOUT AGENT
WET BURST STRENGTH kg/cm2
4,000
3,800
3,600
3,400
3,200
3,000
2,800
2,600
0
1
2
3
4
DYEING TIME HRS.

KERATINOUS TEXTILE TREATMENT WITH ARYLATING COMPOUNDS CONTAINING FIBRE REACTIVE GROUPS

This is a continuation of co-pending application Ser. No. 775,136 filed on Sept. 12, 1985, now abandoned, which in turn is a continuation-in-part of application Ser. No. 577,131 filed on Feb. 6, 1984, now U.S. Pat. No. 4,563,189 issued on Jan. 7, 1986.

In our U.S. Pat. No. 4,563,189 there is described a method of treating cellulosic, keratinous and polyamide textiles to increase their affinity for disperse and certain selected cationic water soluble dyes. Also, there are disclosed certain novel agents including those having formulae I below

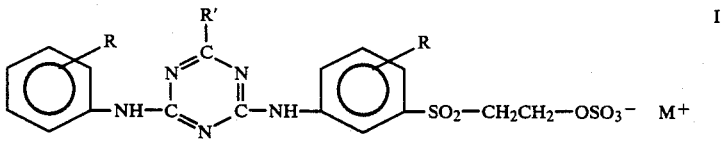

I

In addition to these novel agents other agents, which may be classified, along with those above, as reactive hydrophobes, have now been found to be useful for treating deratinous fibres to reduce fibre damage during dyeing. Those reactive hydrophobes containing two or more reactive groups have been found to be of additional use for treating wool and cellulosic fibres to improve the degree of dye-fibre reaction, to covalently crosslink dyes containing nucleophilic centres to wool, nylon or cotton, thus imparting a high degree of wet fastness, and to impart 'easy care' properties to cellulosic fabrics.

During dyeing at boiling temperatures in aqueous dyebaths wool loses proteins into solution due to hydrolysis of amide and disulphide residues in the polypeptide molecules which make up the fibre. The extent of this hydrolysis depends on pH, previous fibre history, and duration of treatment.

In the worst cases of damage, weight losses of up to 20% of the original fibre weight can occur. Agents are available which are claimed to reduce this damage. Two types of agent are currently marketed, viz.

Protein

Formaldehyde or formaldehyde derivatives

Our experiments have led us to conclude that the use of either of these agents have little measurable effect on fibre strength losses when dyeing at the boil. In marked contrast the present invention provides the use of reactive hydrophobic compounds in boiling dyebaths to give measurable strength improvements. Additionally, formaldehyde and formaldehyde condensates are losing favour owing to possible odour and health and safety problems.

One group of reactive dyes employed with cellulosic fibres are the Remazol dyes. During the dyeing process approximately 60 to 70% of the dyes fixes to the cellulosic fibre while the remainder is hydrolysed and has to be washed off or the material dyed will have poor wet fastness. It would be advantageous if a cheap water soluble cross linking agent could be found to bind the hydrolysed dyestuff to the fibre and thereby increase the degree of fixation and reduce the amount of washing off required for the achievement of maximum wet fastness.

Cross linking of cellulose fabrics brings crease recovery improvement and gives an 'easy-care' finish. Presently this is performed almost exclusively with finishes based on Urea/formaldehyde resins or N-methylol derivatives. However, as mentioned above, there are serious reservations about the health and safety aspects of these compounds. It would therefore be desirable if equally cheap and effective easy care finishing agents could be developed not suffering from these disadvantages. The invention seeks to provide treatment methods improved in the above respects and certain novel textile treatment agents which may be employed therein and in other end-uses, which are cheap to produce, water soluble or dispersible, and sufficiently reactive not to require extreme reaction conditions.

Figure 1:
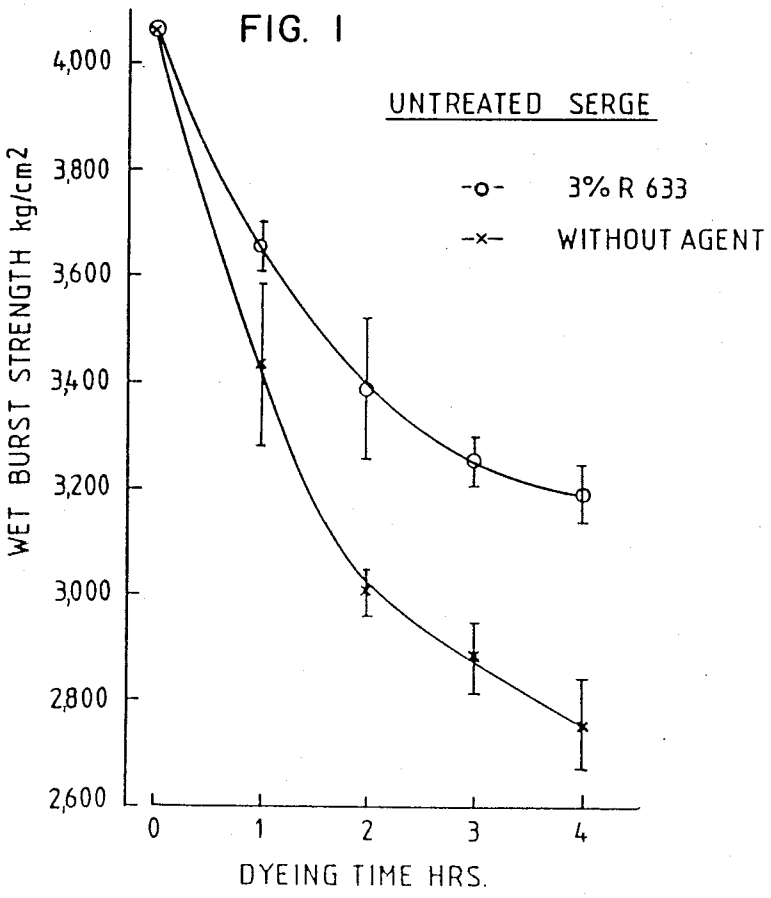

In the Drawings:

FIG. 1 is a graph showing dyeing time Hrs. vs. Wet Burst Strength (kg/cm$^2$) for Untreated Serge, and FIG. 2 is a graph showing dyeing time Hrs. vs. Wet Burst Strength (kg/cm$^2$) for Chlorinated Serge.

According to one aspect of the present invention there is provided textile treating agents of the formula:

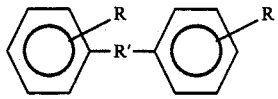

(II)

wherein R is selected from hydrogen, alkyl, alkoxy, halogen, isocyanate, vinyl sulphone and vinyl sulphone precursors; R' is a covalent bond or a divalent linking group; and wherein there is at least one vinyl sulphone group or vinyl sulphone precursor present.

When R' is a divalent linking group it may be selected from, inter alia:

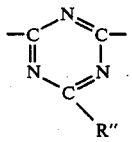

—CO—NH—,

—$SO_2$—NH—, or the like.

The vinyl sulphone precursor may be selected from the following, among others:

—$SO_2$—$CH_2CH_2$—$SSO_3$—M+

—$SO_2$—$CH_2CH_2N(CH_3)$—$CH_2CH_2$—$SO_3^-$ M+

-continued

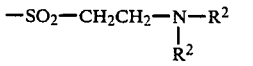

Wherein $R^2$ is hydrogen or an alkyl group and M+ is a monovalent cation.

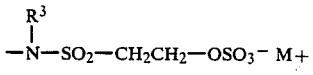

Wherein $R^3$ may be a hydrogen but is preferably a lower alkyl group such as methyl. However, compounds of formulae II below are not included as these have been described and claimed in our above mentioned European application:

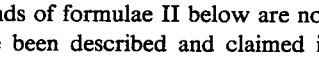

(III)

According to another aspect of the present invention there is provided a method of treating keratinous textiles to reduce damage during dyeing which comprises adding an effective amount of an arylating agent to the dye bath.

The arylating agent may be of the formula

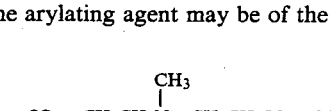

(IV)

wherein

Ar is an aromatic residue such as substituted or unsubstituted benzene or naphthalene ring;

X is a bridging group such as $—SO_2—$, —CO— or —NH—;

Y is a reactive group such as halotriazines, e.g., 2,4-dichloro-s-triazine or monochloro-s-triazine, and quaternary ammonium salts of triazine; and n is 1 to 3

Examples of X-Y include, without limitation, vinyl sulphone, vinyl sulphone precursors such as $—SO_2—CH_2—CH_2OSO_3^-$; sulpho-s-triazines, 2,4-difluoro-6-chloropyrimidine, -haloacrylamides; di-bromo propionyl-amide groups, -haloacetyl groups, acyl-S-thiosulphates, and the like.

The arylating agents also include those according to the first as part of the invention of formula (II). Fibre damage during dyeing may be reduced substantially by the above method The invention further provides a method of treating polyamide and cellulosic textiles to improve the degree of dye-fibre reaction in dyeing to improve wet-fastness, which comprises treating the textile with a compound of formula (IV) above wherein n is 2 or 3.

Application of arylating agents in accordance with the invention has been found to have the following additional advantageous effects as well as those discussed above with respect to dyeing:

(a) On cellulosic textiles the wet and dry wrinkle recovery properties are improved giving 'easy-care' properties; and (b) On keratinous fibres an improvement is moth-resistance. This is believed to be related to the fibre protection given during dyeing—the fibre is, in effect, made indigestible to moth larvae.

In order to obtain the easy-care properties an cellulosic fibres it is preferred to apply a weakly alkaline conditioner and thereafter heat cure the arylating agent.

The dyestuffs for which the above method can increase fibre/dye bonding include those with a sulphonate group and a nucleophilic group, and wet fastness is significantly improved on dyeing in accordance with this method.

The compounds employed are preferably di- or tri-functional, e.g. have 2 or 3 vinyl sulphone precursors. The amount of treating agent employed is preferably between 1 and 20% on weight of fibre (OWF) and is conveniently in the range 1 to 5% OWF.

The agent may be applied by exhaustion from long liquors or using padding methods when impregnation is followed by a fixation process which may comprise batching and/or steaming and/or thermofixation.

If applied by exhaustion, the agent is dissolved or dispersed in water and added to the treatment bath along with normal dyebath auxiliary products and salts as required. The textile fabric is immersed in the bath which is raised to the boil and boiling continued for a period of, for example, from 10 minutes to 2 hours. Where the agent is applied by padding, the agent is dispersed or dissolved in water together with a swelling agent for the textiles, for example urea, and a thickener. The fabric may be padded, batched or steamed or to fix the reagent and rinsed to remove unfixed agent or alternatively padded with the reactive agent, batched for periods up to 48 hours to allow reaction to occur and then rinsed to remove unfixed reagent. Where the agent is employed in dyeing applications it will usually be applied simultaneously with the dyeing operation. It may be beneficial to add the compound to the dyebath at the start of dyeing or in some cases, for example when the agent is employed to increase the degree of covalent reaction dye with fibre, it may be more beneficial to add the agent towards the end of the dyeing cycle in order to maximise the level dyeing possibilities.

It is particularly important that the agent exhibits substantivity for the fibrous substrate. This is achieved by the presence of one or more aromatic ring systems increasing the Van der Waal's interactions and, in the case of wool or polyamide fibres, is enhanced if the reactive group is anionic.

The invention will be illustrated by the following examples.

EXAMPLE 1

The characterisation of damage occurring during dyeing of wool is often difficult but two tests have proved to be useful guide lines and are used herein. These are:

fabric wet burst strength measurements in $Kg/cm^2$ alkali solubility test. (This test measures the solubility of wool in 0.1M sodium Hydroxide at 65° C. for 1 hr.)

The lower the alkali solubility the more the wool is crosslinked (less damaged).

The following compounds were tested:

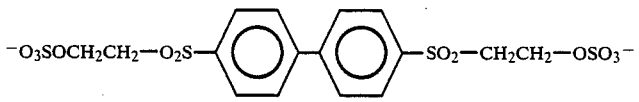

(VIII)

and

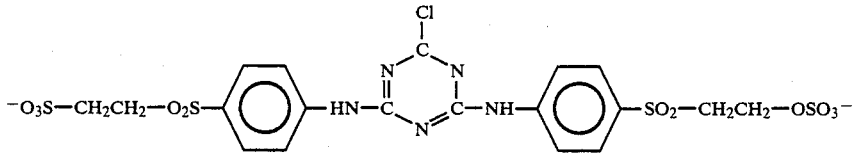

(IX)

(Compound BAB in our above U.S. Patent).

An untreated serge fabric was blank dyed by treating 2 hours at the boil in a bath containing 1% o.w.f. sodium acetate, employing a liquor to goods ratio of 30:1. The pH of the bath was 7.2. (These conditions would be employed when dyeing wool with 2:1 premetallized dyes).

The above experiment was repeated but in this case 1% o.w.f. or 3% o.w.f. of either compound VIII or IX were included in the bath.

Results for wet burst strength (WBS) and alkalii solubility (AS) are given in the following table:

| Treatment | WBS ($Kg/cm^2$) | % strength increase | AS % |
|---|---|---|---|
| Blank dyed only | 3.3 | — | 14.0 |
| Blank dyed + 1% VIII | 3.6 | 9.1 | 12.5 |
| Blank dyed + 3% VIII | 3.7 | 12.1 | 10.3 |
| Blank dyed + 1% IX | 3.6 | 9.1 | 11.0 |
| Blank dyed + 3% IX | 3.8 | 15.1 | 8.4 |

Damage during dyeing is often compounded by oxidising the wool beforehand. Such oxidising treatments may well include a chlorination procedure which imparts shrink resistance. Wool serge was therefore prechlorinated using a winch treatment with 4% o.w.f. Basolan DC (sodium dichloro-iso-cyanurate).

This prechlorinated fabric was treated exactly as described in Example 1 and wet burst strengths and alkali solubility figures obtained are shown in the following table:

| Treatment | WBS ($Kg/cm^2$) | % strength increase | AS % |
|---|---|---|---|
| Blank dyed only | 3.5 | — | 17.5 |
| Blank dyed + 1% VIII | 3.6 | 2.8 | 15.6% |
| Blank dyed + 3% VIII | 3.7 | 5.7 | 14.0 |
| Blank dyed + 1% IX | 3.6 | 2.8 | 15.5 |
| Blank dyed + 3% IX | 3.7 | 5.7 | 12.5 |

These two experiments indicate the addition of compounds of this type is able to help preserve the wool fibre strength under normal boiling dyeing conditions. When dyeing under extremely severe conditions as may be required for dyeing wool/polyester blends (e.g. 1 hr at 120° C.) then the influence of these compounds in preserving wool fibre properties could be extremely significant.

EXAMPLE 2

In this example we blanked dyed an untreated botany wool serge fabric at pH 4 for 2 hrs at 100° C. in the presence of 3% o.w.f. and 5% o.w.f. of the crosslinking compounds of formulae VIII and IX and the monofunctional sulphatoethyl sulphone derivatives:

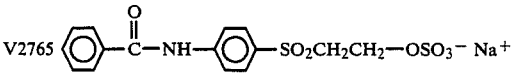

(V)

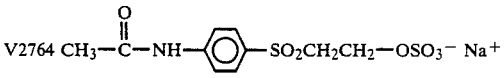

(VI)

The strength loss was measured as the percentage change in wet burst strength from the original fabric and is shown in the following table.

| Treatment | Wet Burst Strength | % Strength Loss |
|---|---|---|
| Original fabric | 4.060 $kg/cm^2$ | 0 |
| Blank dyed | 3.000 $kg/cm^2$ | 26.1 |
| Blank dyed + 3% R633 (IX) | 3.390 $kg/cm^2$ | 16.5 |
| Blank dyed + 5% R633 (IX) | 3.400 $kg/cm^2$ | 16.3 |
| Blank dyed + 3% V2765 | 3.460 $kg/cm^2$ | 14.8 |
| Blank dyed + 5% V2765 | 3.650 $kg/cm^2$ | 10.1 |
| Blank dyed + 3% V2764 | 3.290 $kg/cm^2$ | 19.0 |
| Blank dyed + 5% V2764 | 3.480 $kg/cm^2$ | 14.3 |
| Blank dyed + 3% V387 (VIII) | 3.350 $kg/cm^2$ | 17.5 |
| Blank dyed + 5% V387 (VIII) | 3.390 $kg/cm^2$ | 16.5 |

These results indicate that the crosslinking compounds IX and VIII significantly protects the wool against strength losses during dyeing, but the monofunctional reactive hydrophobe V2765 appears to be even more effective. This is a surprising result and indicates that protection is probably achieved by a combination of covalent attachment through reaction with nucleophilic sites in wool and by the hydrophobic character of the introduced group. (The superiority of V2765 over V 2764 confirms this latter point).

EXAMPLE 3

A dyebath was prepared containing 1% o.w.f. Sandolan Turpuoise E-AS 2))% (acid levelling dye), 1% o.w.f. formic acid (85%) and 10% o.w.f. sodium sulphate. Wool serge was added to the bath and the bath raised to the boil over 30 minutes and boiling continued for 2 hours. The above was repeated in the presence of the reactive crosslinking agent (VIII) V387 (3% o.w.f.). Damage during dyeing was estimated using the wet burst strength test—without the crosslinker the strength loss during dyeing was 29% but with the corsslinker a strength loss of 19% was recorded.

EXAMPLE 4

Blank dyebaths were set at pH 4 with 1% Albegal B, 2% sodium acetate and sufficient acetic acid to maintain the desired pH. Chlorinated and untreated wool serge was added and the baths raised to the boil and boiling continued 1, 2, 3 and 4 hours. Samples from each of these different boiling times were then tested for wet butst strength in order to assess damage during dyeing. The procedure was repeated using in addition to the above dyebath additives 3% o.w.f. of the trifunctional crosslinking agent IX. For convenience the results are illustrated graphically in FIG. 1 of the accompanying drawings. It is clear that the addition of the crosslinking agent is extremely beneficial.

When the above results are calculated on the basis of % strength loss from the original the following figures are obtained.

| Dyeing time (at 100° C.) | Reactive cross-linker IX | % strength loss |
|---|---|---|
| 1 hr | 0 | 15.5 |
| 1 hr | 3% | 10.1 |
| 2 hr | 0 | 25.6 |
| 2 hr | 3% | 16.5 |
| 3 hr | 0 | 29.3 |
| 3 hr | 3% | 19.9 |
| 4 hr | 0 | 32.3 |
| 4 hr | 3% | 21.4 |

The above results indicate that the addition of the reactive cross linkers is even more desirable as dyeing times are increased. Under practical conditions this is very important since extended dyeing times at the boil frequently occur when dyeing to deep shades or when making shading additions in matching to a difficult shade. The use of such reactive agents in these situations could prove to be of paramount importance in preserving fabric handle, weight and physical properties so important in subsequent wearing performance

EXAMPLE 5

Wool dyebaths were set at pH 4 with 2% sodium acetate, 2% acetic acid and 1% Albegal B. Various reactive hydrophobes described in our co-pending European application No. 84300543 were applied individually at 3% o.w.f. to wool serge for 2 hours at boiling temperature. The fabrics were tested for wet burst strength and the following results obtained:

| Treatment Agent (3% o.w.f.) | West burst strength kg/cm$^2$ |
|---|---|
| None (Blank dyed only) | 2.950 |

-continued

| Treatment Agent (3% o.w.f.) | West burst strength kg/cm$^2$ |
|---|---|
| 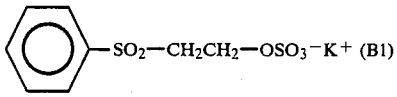 (B1) | 3.470 |
| 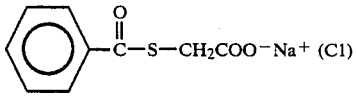 (C1) | 3.360 |
| 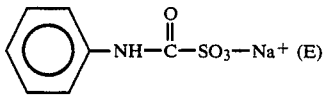 (E) | 3.392 |
| * 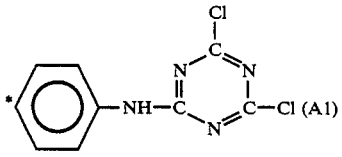 (A1) | 3.495 |

*Applied as a dispersion

EXAMPLE 6

In the late 1960's BSAF introduced a range of reactive dyes called Basazols. These dyes were in fact sulphonated chromophores with nucleophilic groups in side chains, i.e.

$$^{-}O_3S—D—XH$$

where X=NH, or 0.

The dyes were fixed to the fibre by a cross linking agent triacroylaminohexahydrotriazine (Fixing Agent P). The advantages claimed for this system were that this fixing agent was cheap enough to be used in excess and therefore hydrolysis side reactions were not as significant as in conventional reactive dyes. Problems which led to the abandonment of this interesting approach included the low reactivity of the acroylamino groups, the relatively poor aqueous solubility of Fixing agent P and the restriction of the process to printing due to the low substantivity of the crosslinker.

With compounds such as VIII and IX, we are able to improve this method of dyeing. Such crosslinkers have very high reactivity when converted to the free vinyl sulphone form and also in their sulphato ethyl sulphone form, show high water solubility (IX has an aqueous solubility of about 150 g/l at 20° C.) and good substantivity.

The compounds based on sodium p-amino benzene sulphato ethyl sulphone are also cheap to prepare. Particularly useful compounds would include:

IX (BAB) (i)

VIII (ii)

-continued (iii)

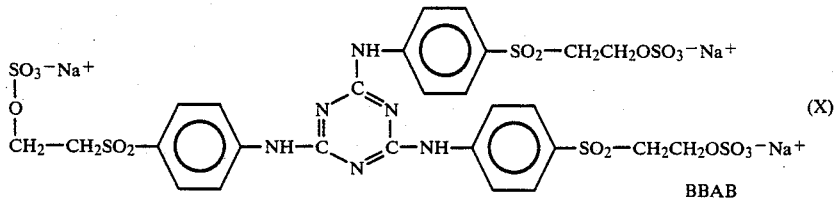

(X)

BBAB (iv)

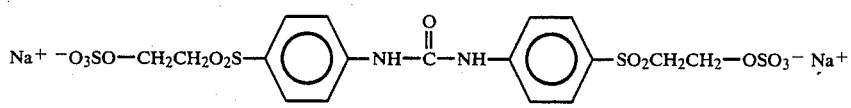

(prepared by the action of phosgene on sodium-p-amino benzene sulphato ethyl sulphone)

There are a number of possible ways of 'blocking' or masking a vinyl sulphone group preferably to impart water solubility. 'Unblocking' to the reactive vinyl sulphone form is usually brought about by the addition of alkali or simply by heating aqueous solutions up to the boil (above a critical pH limit—usually 4–5). Typical examples of the blocked vinyl sulphone groups are:

| Compound | Activation reaction products |
|---|---|
| $R-SO_2-CH_2CH_2-OSO_3^-Na^+$ | $R-SO_2-CH=CH_2 + NaHSO_4$ |
| $R-SO_2-CH_2CH_2-SSO_3^-Na^+$ | $R-SO_2-CH=CH_2 + Na_2S_2O_3$ |
| $R-SO_2-CH_2CH_2-N(CH_3)-CH_2CH_2-SO_3^-Na^+$ | $R-SO_2-CH=CH_2 + HN(CH_3)-CH_2CH_2SO_3^-Na^+$ |
| $R-SO_2-CH_2CH_2-N(R^1)-R^1$ | $R-SO_2-CH=CH_2 + HN(R^1)(R^1)$ |

The vinyl sulphone group can also be attached to the dye or crosslinking agent as an arylaminovinyl sulphone:

e.g. $Ar-N(R)-SO_2CH_2CH_2-OSO_3^-Na^+$

If R is hydrogen the reactivity is very low and these products can only be applied by thermofixation, but if R is an alkyl group such as $CH_3$ then the reactivity is adequate for normal dyeing and printing applications.

Treatment

Wool was dyed for 1 hour at the boil with 2% o.w.f. Acid Violet 9,

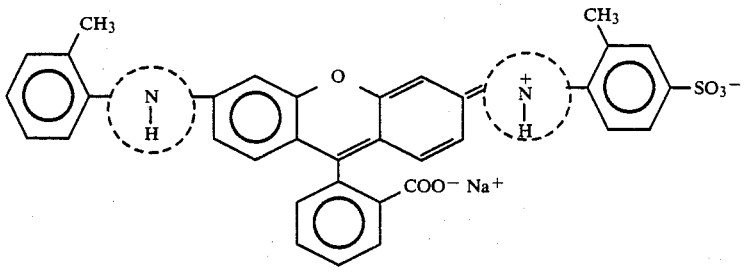

using 2% o.w.f. sulphuric acid and 10% o.w.f. sodium sulphate. (∴ indicates nucleophilic center in the dye).

The dyeing was rinsed in water and tested for wash fastness using the ISO3 test. A change in shade rating of 2 was observed indicating most of the dye was removed from the fabric during washiug. Scale of shade change is from 5 to 1; 5 indicates no colour removable in washing, 1 indicates almost all colour washed out.

The above procedure was repeated except that after ½ hour at the boil, compound IX (3% o.w.f.) was added and the pH adjusted to 5. Boiling was continued a further hour in order to bring about reaction of the crosslinking agent with the fibre and the dyestuff. Rinsing completed the process.

On tested for washing fastness (ISO3) a shade of change of 4 was noted indicating significant covalent bonding of dye to the fibre. Cotton fabric was padded to 100% wet pick-up with a pad-liquor containing:

20 g/l Acid Violet 9
40 g/l Compound IX
40 g/l sodium carbonate

The goods were dried and then steamed to bring about dye-crosslinker-fibre bonding.

The dyeing goods displayed very good wet fastness properties. When the experiment was repeated but omitting compound IX from the pad-liquor, then wet fastness properties were very poor.

EXAMPLE 7

Improvement of Reactive Dye Yields on Cellulose

Hydrolysed Remazol reactive dyes have the structure:

$^{-}O_3S—D—SO_2—CH_2CH_2OH,$ and it is possible to fix (covalently bond) this hydrolysed dye to the fibre by employing compounds of the invention according to the following scheme:

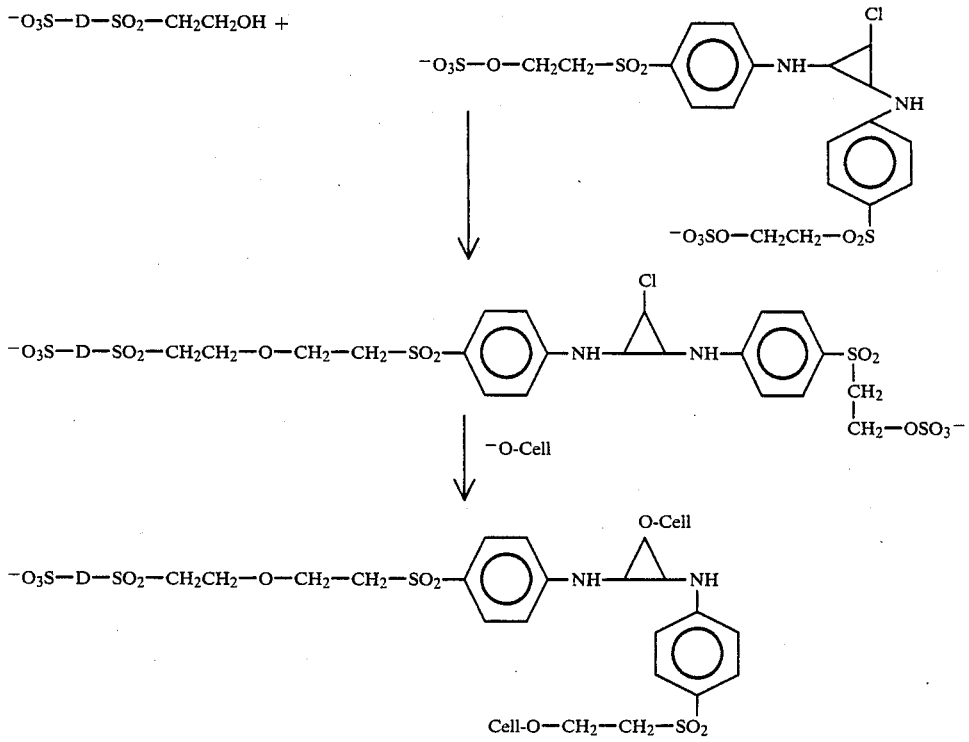

This is of great benefit since reactive dyes on cellulose rarely exceed 60–70% covalent bonding leaving 30–40% of hydrolysed dye to be soaped off in order to achieve maximum wet fastness properties. An example of the use of the compounds in this manner is:

Cotton fabric was padded to 80% wet pick-up with the following pad-liquor:

| | |
|---|---|
| Remazol Brilliant Blue R | 20 g/kg |
| Compound IX | 30 g/kg |
| Crossfields No. 1 Silicate | 181 g/l |
| Sodium Hydroxide (10% w/v) | 117 g/l |

The impregnated fabric was batched overnight and washed off thoroughly in water and soaped at the boil.

When the above was repeated in the absence of compound IX it was noted that significantly more colour was removed during soaping and that the final shade was weaker.

EXAMPLE 8

Crosslinking of cellulosic fabrics brings about crease recovery improvement to give easy care fabrics. Today the commercial field is dominated by easy care finishes based on urea/formaldehyde or various N-methylol derivatives but there are serious reservations about the health and safety aspects of formaldehyde.

Compounds of the invention, for example compounds VIII, IX and X, may be applied from a weakly alkaline pad-liquor to cotton fabrics; the fabrics on drying and curing at 150° C.–180° C. for 1–3 mins. exhibit durable press, easy care properties.

Thus the following pad liquor was prepared.

| | |
|---|---|
| 80 g/l | compound IX |
| 30 g/l | sodium carbonate |
| 5 g/l | Aerosol OT (di-isoacrylsulpho succinate wetting agent) |

Cotton fabric was padded through this liquor to 90% wet pick-up, batched overnight at room temperature and then aired for 1 minute at 180° C. The durable press ratings (wet and dry) were very significantly improved compared with the original fabric.

EXAMPLE 9

This example covers the observed improvement in wet fastness properties of dyeings carried out in the presence of the reactive hydrophobes/cross linkers. In all cases 2% dye was applied to wool serge fabric in the presence of 3% reactive compound from a bath containing 1% Albegal B, 2% sodium acetate and acetic acid to pH 4. Dyeing was carried out by raising to the boil and boiling for 1 hour. Wet fastness was determined using the ISO 2 test (5 g/l soap 50° C. for 45 minutes) and the ISO 3 test (5 g/l soap, 2 g/l sodium carbonate 30 minutes 60° C.). Ratings are on a scale 1–5, 1 being very poor and 5 being excellent (i.e. no colour change or staining).

| Compound | Test | Dye | Rating (change in shade) |
|---|---|---|---|
| IX | ISO 2 | Sandolan Fast Yellow PL | 5 |
| None | " | " | 4 |
| IX | ISO 3 | " | 4–5 |
| None | " | " | 2 |
| IX | ISO 2 | Sandolan Violet E-2R | 2–3 |
| None | " | " | 1–2 |
| IX | ISO 3 | " | 2 |
| None | " | " | 1 |
| 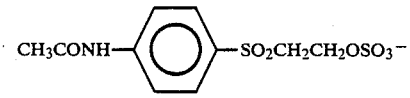 | ISO 2 | " | 1–2 |
| " | ISO 3 | " | 1 |
| 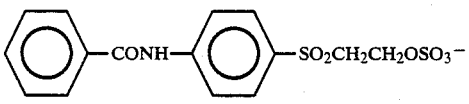 | ISO 2 | " | 2 |
| " | ISO 3 | " | 1 |
| IX | ISO 2 | Sandolan Milling Red NF-BL | 5 |
| None | " | " | 4 |
| IX | ISO 3 | " | 3 |
| None | " | " | 2 |
| IX | ISO 2 | Sandolan Reed E-BL | 3 |
| None | " | " | 2 |
| IX | " | " | 3 |
| None | " | " | 1 |
| IX | ISO 2 | Sandolan Fast Red P-2BL | 3–4 |
| None | " | " | 2 |
| IX | ISO 3 | " | 3 |
| None | " | " | 1 |

A study of these results indicates that the hydrophobic cross linking agent IX has the greatest effect on improving wet fastness properties. This should have benefits in piece dyeing all-wool fabrics since in order to achieve maximum levelness. Level dyeing dyes such as Sandolan E or R are preferred, but these unfortunately to not exhibit adequate wet fastness for all applications—by dyeing in the presence of compound IX these wet fastness problems may be overcome (especially with the Sandolan P dyes).

I claim:

1. A method of treating keratinous textiles to reduce damage during dyeing which comprises applying to an untreated textile material during dyeing at the boil, under neutral or acidic conditions, an aqueous solution or dispersion containing from 1 to 20% on weight of fibre of an arylating agent having the formula $Ar_m$-$(X\text{-}Y)_n$ wherein Ar is an unsubstituted or substituted benzene or naphthylene ring; Y is a chlorotriazine or a quaternary ammonium salt of triazine; and X is a divalent bridging group selected from —$SO_2$—, —CO— or —NH—; or where X and Y taken together form a vinyl sulphone, a vinyl sulphone precursor, a sulpho-S-triazine, 2,4-difluoro-6-chlorpyrimidine, a haloacrylamide, a di-bromopropionylamide, a haloacetyl or an acyl-S-thiosulphate group; m is 1 or 2; and n=1, 2 or 3.

2. The method of claim 1 wherein Y is a chlorotriazine or a quaternary ammonium salt of triazine and X is NH or X-Y is a sulpho-S-triazine or 2,4-difluoro-6-chlorpyrimidine.

3. The method of claim 1 wherein the amount of agent employed is in the range 1 to 5% on weight of fibre.

4. The method of claim 1 wherein the treatment takes place under acidic conditions.

5. The method of claim 4 wherein the treatment takes place at a pH of about 4.

6. The method of claim 1 wherein the arylating agent is:

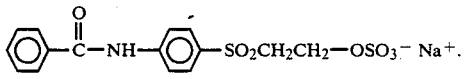

7. The method of claim 1 wherein the arylating agent is:

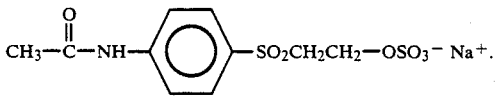

* * * * *